US005418336A

United States Patent [19]

Negishi et al.

[11] Patent Number: 5,418,336

[45] Date of Patent: May 23, 1995

[54] SOUND OUTPUT DEVICE

[75] Inventors: Hiro Negishi; Michael D. G. Jewitt, both of Guildford, Great Britain

[73] Assignee: Canon Research Centre Europe Ltd., Surrey, Great Britain

[21] Appl. No.: 30,241

[22] PCT Filed: Oct. 16, 1991

[86] PCT No.: PCT/GB91/01806

§ 371 Date: Apr. 28, 1993

§ 102(e) Date: Apr. 28, 1993

[87] PCT Pub. No.: WO92/07449

PCT Pub. Date: Apr. 30, 1992

[30] Foreign Application Priority Data

Oct. 17, 1990 [GB] United Kingdom ..... 90 22 553.3
May 31, 1991 [GB] United Kingdom ..... 91 11 775.4

[51] Int. Cl.[6] ..... H04R 1/32

[52] U.S. Cl. ..... 181/155; 181/156

[58] Field of Search ..... 181/155, 156, 152, 153, 181/151, 159, 164, 150, 199; 381/90, 156, 158, 159, 160

[56] References Cited

U.S. PATENT DOCUMENTS

| | | | |
|---|---|---|---|
| 2,956,636 | 10/1960 | Boersma | 181/155 |
| 4,134,471 | 1/1979 | Queen | 181/147 |
| 4,144,416 | 3/1979 | Babb | 181/156 X |
| 4,620,317 | 10/1986 | Anderson | 181/155 X |
| 4,836,329 | 6/1989 | Klayman | 181/155 |
| 4,907,671 | 3/1990 | Wiley | 181/156 |

FOREIGN PATENT DOCUMENTS

| | | |
|---|---|---|
| 1418976 | 11/1977 | Australia . |
| 0095872 | 12/1983 | European Pat. Off. . |
| 0095876 | 12/1983 | European Pat. Off. . |
| 0320270 | 6/1989 | European Pat. Off. . |
| 0409360 | 1/1991 | European Pat. Off. . |
| 1001734 | 2/1952 | France . |
| 0362097 | 4/1990 | France . |
| 2325603 | 12/1974 | Germany . |
| 308318 | 6/1930 | United Kingdom . |
| 445935 | 4/1936 | United Kingdom . |
| 665815 | 1/1952 | United Kingdom . |
| 744167 | 2/1956 | United Kingdom . |
| 2007461 | 5/1979 | United Kingdom . |
| 2056815 | 3/1981 | United Kingdom . |
| 2139040 | 10/1984 | United Kingdom . |
| 2184323 | 6/1987 | United Kingdom . |
| 2188811 | 10/1987 | United Kingdom . |
| 2195218 | 3/1988 | United Kingdom . |
| 2226214 | 6/1990 | United Kingdom . |
| 2245450 | 1/1992 | United Kingdom . |
| 2248996 | 4/1992 | United Kingdom . |
| WO8911201 | 11/1989 | WIPO . |
| WO9007850 | 7/1990 | WIPO . |

*Primary Examiner*—D. Rutledge
*Attorney, Agent, or Firm*—Fitzpatrick, Cella, Harper & Scinto

[57] ABSTRACT

A speaker unit includes a speaker housing having a lower portion and an upper portion. A drive unit is housed in the upper portion for producing and outputting sound, with the drive unit having a central axis, and a sound mirror is housed in the lower portion for reflecting the sound output by the drive unit. The mirror has a generally conical surface facing the drive unit for redirecting sound therefrom into a generally horizontal direction and a cone shape, with an apex of the cone being closest to the drive unit. A supporter supports the drive unit in a cantilever type manner above the sound mirror, and the center axis of the drive unit is offset from the apex of the sound mirror, with the drive unit supporter positioned at substantially the opposite side of the apex than the center of the drive unit.

28 Claims, 12 Drawing Sheets

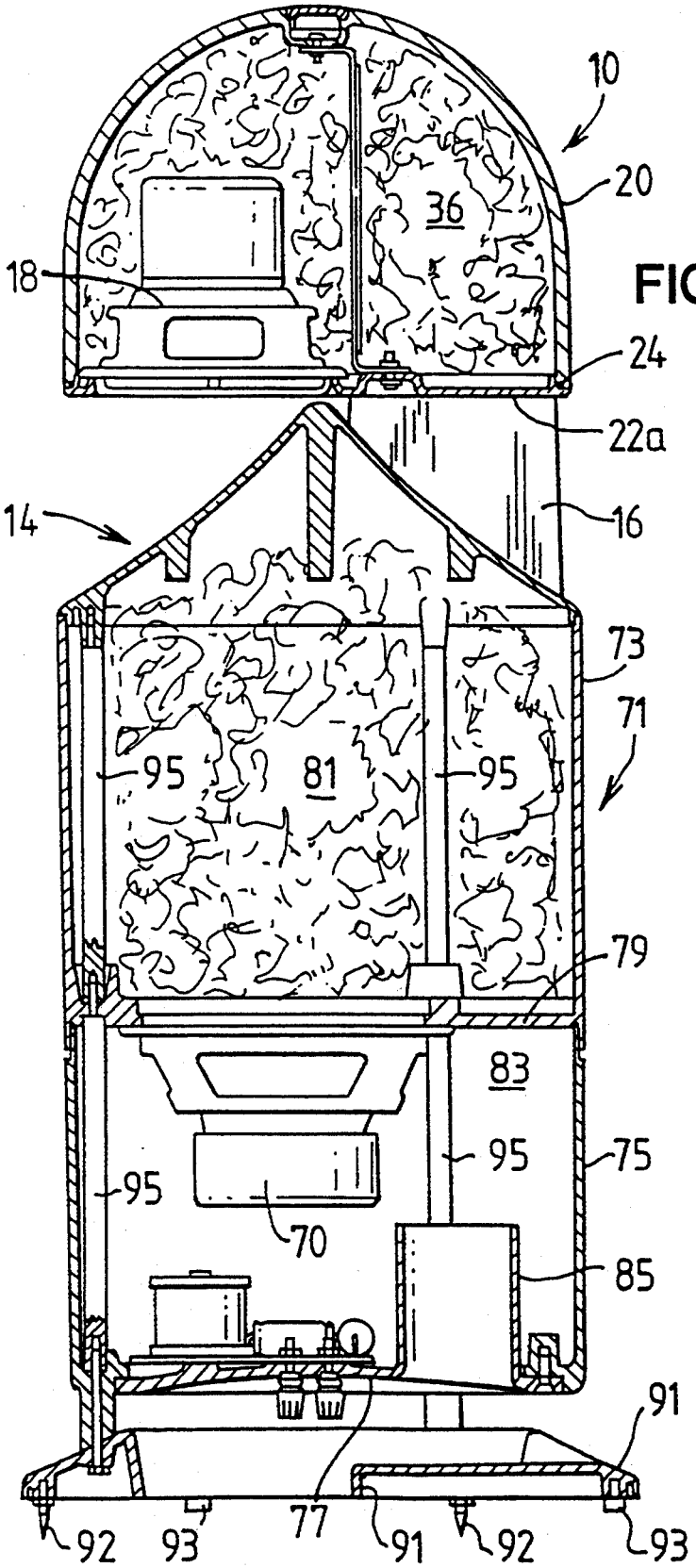
FIG.8
FIG.9
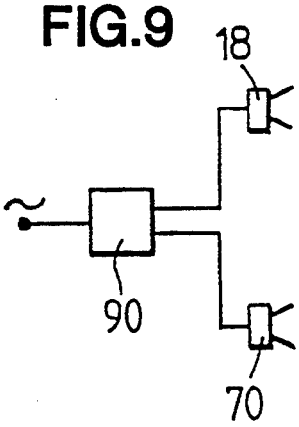

SOUND OUTPUT DEVICE

BACKGROUND OF THE INVENTION

1. Field of Invention

This invention relates to a sound output device or speaker unit which may be incorporated into a stereo audio output system, and more particularly into such a system intended to reproduce sound with high fidelity or near high fidelity and to give rise to a relatively wide field of stereophonic sound.

2. Description of the Prior Art

Our Patent GB-B-2188811 describes a stereo speaker system having a pair of first and second speaker assemblies. Each speaker assembly comprises a speaker having a diaphragm which emits a sound wave in a vertical direction and an acoustic reflector which is disposed above the diaphragm and reflects the sound wave from the diaphragm into a horizontal plane. The surface of the acoustic reflector facing the diaphragm of each speaker assembly is conical with the apex of the cone nearest to the diaphragm. The centre axis of the conical surface of the acoustic reflector is offset from the centre axis of the diaphragm so as to provide a preferential distribution of sound intensity in an intended listening direction and so as to enhance or increase the area over which the stereo image is obtained.

Further aspects of sound output systems using generally conical sound mirrors are disclosed in EP-A-0320270 and EP-A-0409360.

SUMMARY OF THE INVENTION

In one aspect this invention provides a loudspeaker unit comprising an audio mirror and a single drive unit disposed so as to direct sound towards a reflective surface of the audio mirror so that sound is redirected into a predetermined direction, and wherein the drive unit has concentric first and second diaphragms for lower and higher frequencies. It has been found that such a single drive unit which has concentric first and second diaphragms for lower and higher frequencies can be arranged at intermediate and high audible frequencies (e.g frequencies above 5 KHz) to direct a relatively concentrated or narrow beam of sound towards the audio mirror. It has been found that such a relatively concentrated beam of intermediate and high frequency sound when directed onto an audio mirror can be used to produce a distribution of sound which is more reproducible, the sound distribution being controlled by the shape of the diffracting or reflective surface of the audio mirror. Preferably the drive unit is arranged to direct sound downwardly onto the audio mirror or acoustic reflector, referring to the normal attitude in which the loudspeaker unit stands when in use.

The audio mirror or acoustic reflector is arranged to disperse or produce a widened distribution of sound, by reflection or diffraction depending upon frequency, in a first direction and optionally also in a second orthogonal direction, and preferably it has a generally conical surface facing the drive unit with the apex of the cone nearest to the drive unit. The centre of the drive unit may be offset from the axis of the conical surface so as to define a direction for sound leaving the drive unit. The above mentioned requirement for a single drive unit with concentric diaphragms facing the reflective surface of the audio mirror does not exclude the possibility that there may be another speaker, e.g., a bass speaker, which does not direct sound onto the audio mirror.

In one form of the drive unit, the second diaphragm may fit within but be unattached to the first diaphragm, the first and second diaphragms being independently driven by individual voice coils. More preferably, however, the second diaphragm fits within and is attached to the first diaphragm with a single drive vibrating both diaphragms, so that the second diaphragm acts as a so-called "parasitic tweeter", the second diaphragm conveniently being arranged to come into operation at frequencies above 5 KHz. The second diaphragm is preferably relatively narrow and horn-like and assists in the direction of a relatively concentrated beam of high frequency sound towards the audio mirror.

In one form the second diaphragm is circular in outline at its inner and outer ends. The first diaphragm may also be circular in outline at its inner and outer ends. In an alternative form, the second diaphragm is elliptical at least at its outer end and in that case, the first diaphragm may also be elliptical at least at its outer end. When the first or both diaphragms are elliptical, their major axes are preferably directed generally at right angles to a line joining the centre of the drive unit and the axis of the audio mirror. The reason for the choice of this direction is that in an elliptical speaker the distribution of sound emitted along the direction of the major axis of the speaker is relatively narrow and the distribution of the sound emitted along the minor axis of the speaker is relatively wide, so that the selected attitude of the speaker gives a wide field of sound.

In one form of the loudspeaker unit there is a single drive unit which directs sound onto the reflective surface of the audio mirror and there is no other speaker. In that form of the loudspeaker, the drive unit or speaker is advantageously contained within a housing which is closed except for an aperture defining a Helmholtz resonator, the aperture being in the form of a tube whose length is adjusted to provide the required resonance frequency, conveniently about 50 to 60 Hz e.g. about 55 Hz to provide an element of built-in bass lift. The region of the housing opposite to the diaphragm of the speaker or drive unit is advantageously domed to minimise resonances which can arise from the presence of flat surfaces within the housing. In a second form of the loudpseaker unit where there is a separate bass speaker which does not face the reflective surface of the audio mirror, the drive unit or speaker is advantageously contained within a closed housing preferably of similar domed shape and which acts as an infinite baffle enclosure.

In that form of the invention where a separate bass speaker is provided, the single drive unit which faces the audio mirror is arranged to reproduce mid-range and high frequency sound and a drive unit for bass frequencies is provided in a housing to an opposite side of the sound mirror from the single drive unit. The single drive unit and the bass drive unit may be connected to a sound source by a network having a suitable cross-over frequency, e.g., about 160 to 170 Hz. The bass speaker may be mounted in a housing which fits immediately below the audio mirror and which is closed except for an aperture or apertures defining a Helmholtz resonator. Advantageously the aperture or apertures defining the Helmholtz resonator for the bass speaker are downwardly directed with reference to the normal attitude of the unit when in use, so that sound is reflected off the surface of the floor or platform on which the unit stands. In this way, and provided that the aperture or apertures exit adjacent the floor or platform, reflection of the floor can add about 3 db to the output by the phenomenon of "first boundary assistance. The bass speaker is in a housing which preferably has a circular or other smoothly curved side wall.

We have measured the polar distribution of sound radiated from a speaker unit in which sound from a single drive unit is directed onto an audio mirror having a generally conical reflective surface facing the drive unit with the apex of the cone nearest the drive unit and with the centre of the drive unit offset from the axis of the conical surface so as to define the predetermined direction for sound leaving the unit. We have found that there may be a fall off in sound intensity radiated in the intended listening direction at a higher range of frequencies, e.g., at frequencies of 15 to 20 KHz. This problem is solved according to a further aspect of the invention by providing a speaker assembly comprising a tweeter and an audio mirror disposed in the path of sound from the tweeter to cause reflected sound to be radiated in a predetermined listening direction, in which means is disposed between the tweeter and the mirror for directing high frequency sound from the tweeter onto the mirror.

The sound directing means may take the form of one or more vanes disposed between the tweeter and the mirror, the vanes being directed towards the surface of the mirror. The problem of fall off in high frequency sound in the intended listening direction has been observed in relation to speaker assemblies where there is a so-called parasitic tweeter, i.e., there are concentric first and second diaphragms in which the second diaphragms is horn-like and is attached to and vibrates with the first diaphragm, the second diaphragm serving to direct a relatively concentrated beam of sound onto the sound mirror.

Both from an aesthetic and from a sound quality standpoint, it is desirable that there should be no obtrusive struts in the intended listening direction. For that purpose the or each strut which extends between the sound mirror and a housing in which the speaker or drive unit is mounted are on the opposite side with respect to the axis of the acoustic mirror from the drive unit. The housing is therefore supported cantilever-wise above the acoustic mirror, or vice versa, and a problem arises as to how to prevent the struts, which have to be relatively large in such a cantilever support arrangement, from interferring with sound quality.

This problem is solved, according to a further preferred feature of the invention, by having struts whose length is greater than their width and which in their longer direction are directed towards or face the axis of the speaker or drive unit. Advantageously, the or each strut has straight sides leading to a curved end which faces towards the axis of the drive unit, and the sides of the struts converge radially in the direction of the drive unit axis. Preferably the opposed sides or other extremities of the or each strut subtend an angle of 5 to 10 degrees, e.g., about 7.5 degrees at the axis of the drive unit. Although a single strut is possible, the provision of two struts is preferred, and the provision of more than two struts is less preferred. Where two struts are present their angular spacing measured by the spacing of their median or centre lines is preferably in the range 40 to 60 degrees e.g. 50 degrees. Where the speaker or drive unit has a Helmholtz resonator aperture, that aperture is preferably located between the struts so as not to be noticed when the speaker is in use.

BRIEF DESCRIPTION OF THE DRAWINGS

Various forms of the invention will now be described, by way of example only, with reference to the accompanying drawings, in which:

FIG. 8 is a view in vertical section of a third form of a speaker unit according to the invention;

FIG. 9 is a diagram of a cross-over network for use with the speaker of FIG. 8;

DESCRIPTION OF THE PREFERRED EMBODIMENTS

Figure 1:
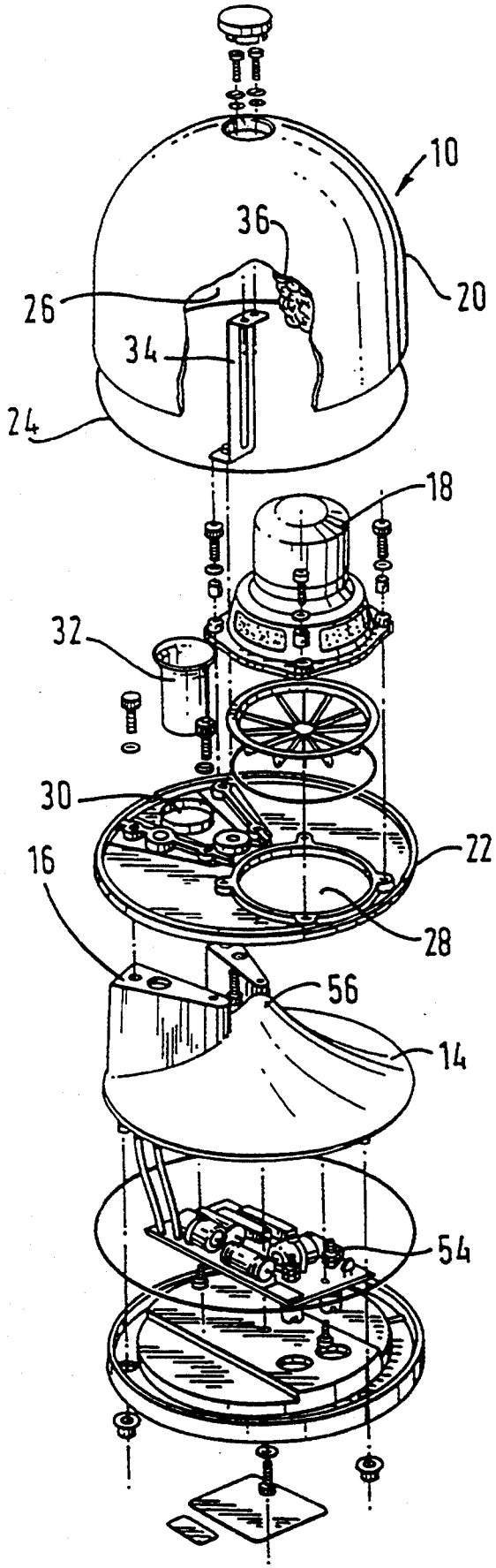
FIG. 1 is an exploded view of a first form of the speaker.
Figure 2:
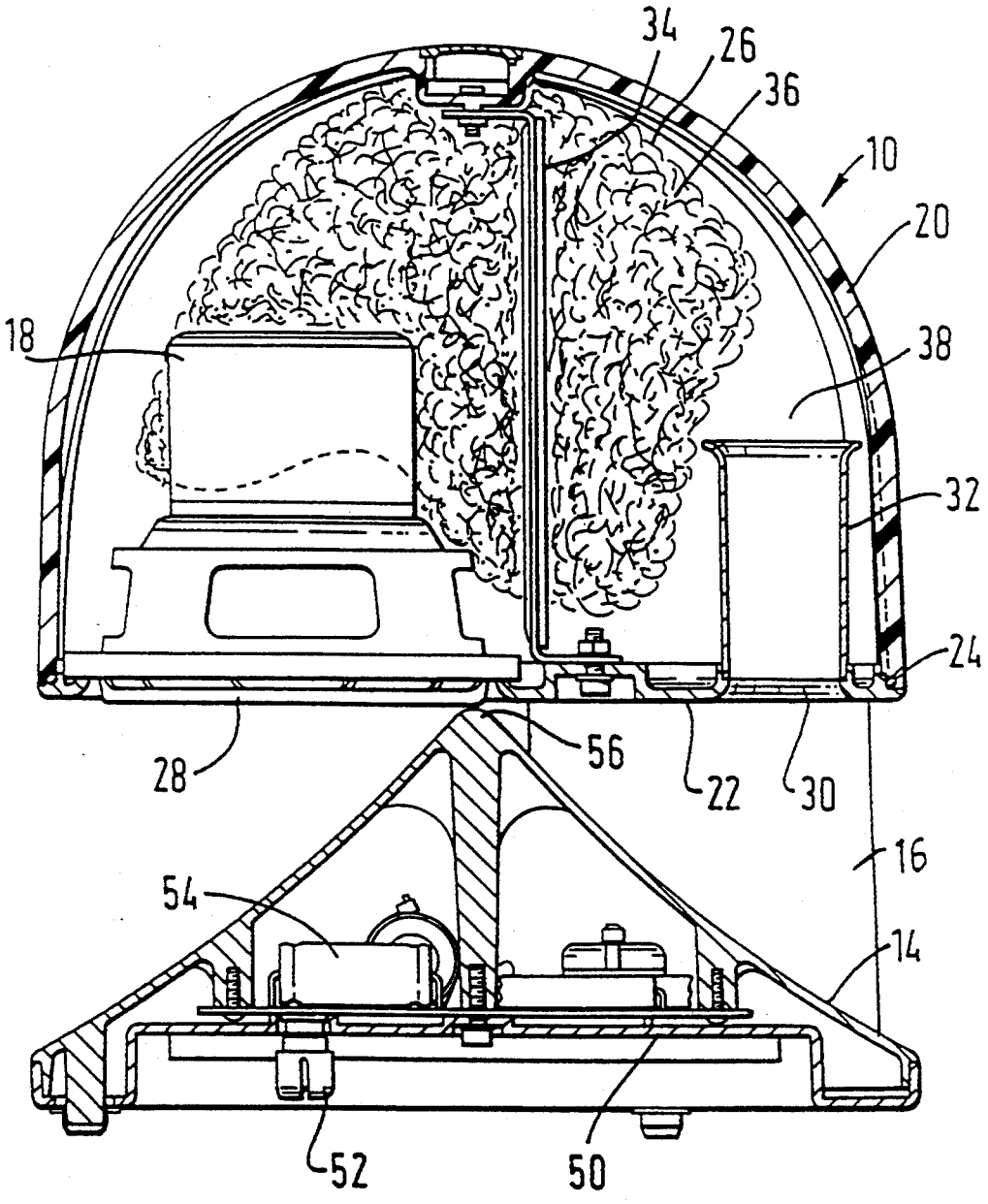
FIG. 2 is a view of the speaker of FIG. 1 in vertical section.
Figure 3:
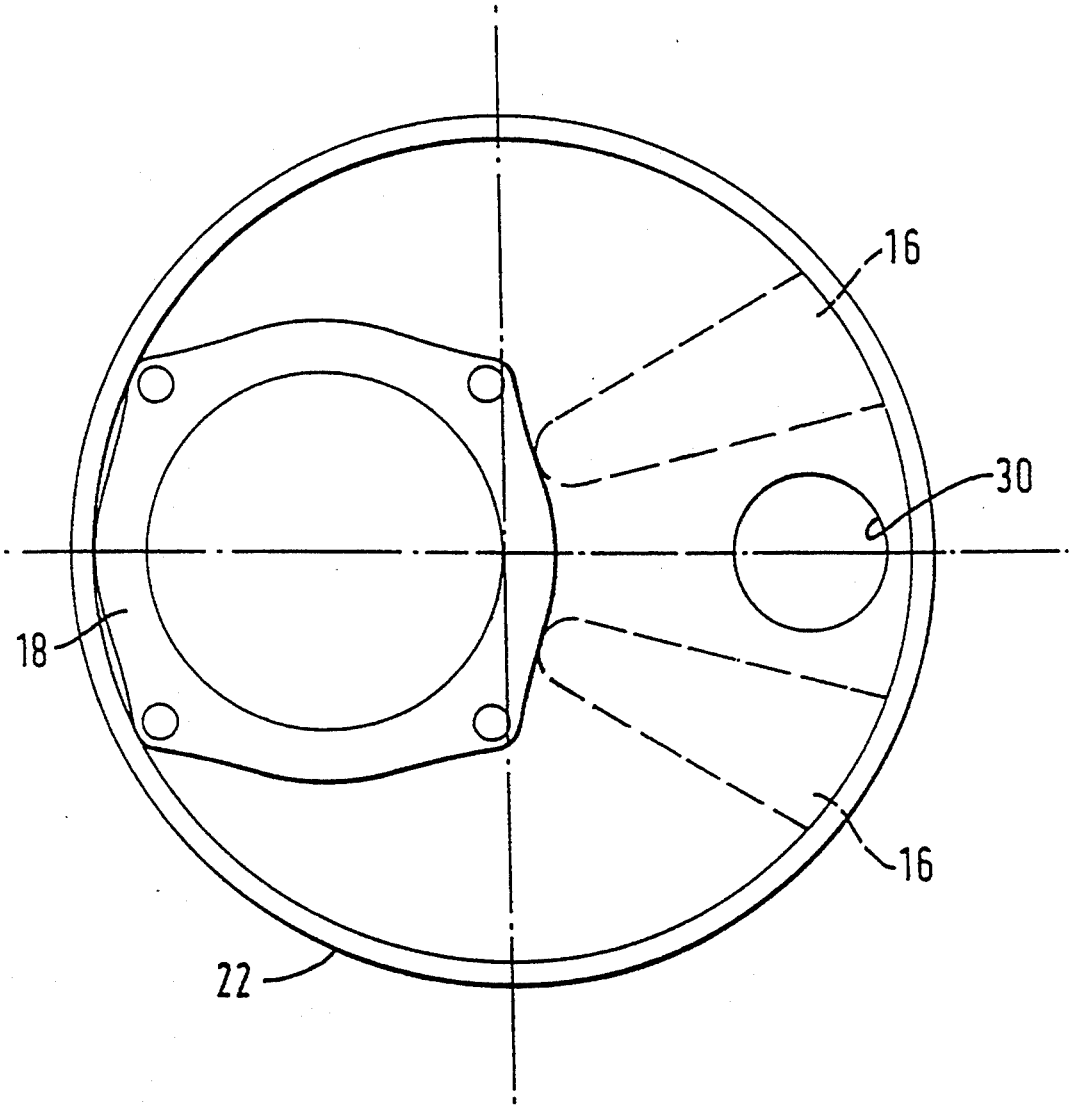
FIG. 3 is a diagrammatic plan view of the speaker showing the relative position of the sound mirror, speaker unit and struts.

In the drawings, a loudspeaker intended to be used on a bookshelf or on a stand in a domestic living room or similar environment as part of a stereophonic sound reproduction system has an overall height of about 300 mm and a diameter of about 255 mm and is circular when viewed in plan. It comprises a speaker housing 10 supported in cantilever manner above a sound mirror 14 by means of struts 16 that form part of and stand up from the sound mirror 14. The housing 10 contains a drive unit 18 whose sound is directed axially onto the sound mirror 14 from which it is directed towards the listener by reflection at high frequencies and diffraction at low frequencies, the sound at mid-range frequencies being directed towards the listener by a combination of these two mechanisms. The sound from the drive unit 18 passes vertically downwards onto the sound mirror 14 in this embodiment, that direction being defined by feet depending from a baseplate 50 on which the sound mirror stands.

The housing 10 comprises a domed top cover 20 and an apertured lower plate 22 which are sealed together by means of an O-ring seal 24. The dome 20 is a moulding in ABS or other plastics material, and the plate 22 is of a zinc alloy. The function of the O-ring seal 24 is to accommodate differences in the expansion characteristics between the two materials and also to provide an air seal for an internal cavity 26 defined beneath the dome 20. Apart from enhancing the appearance of the speaker, the use of the semi-circular domed top cover 20 minimises the presence of flat surfaces within the housing 10 which can give rise to undesired sound reflections. The plate 22 is apertured in a listener-facing direction at 28 to receive the drive unit 18 which is attached by screws or other suitable means and it is formed with a second aperture 30 at a radially opposite position to the aperture 28. A port tube 32 fits into the aperture 30 and extends into the cavity 26. The dome 20 and the lower plate 22 are held together by means of a strap 34. A space occupied by a body of absorbent material 36 within the cavity 26 behind the drive unit 18 leads to a free space 38 adjacent to the port-defining tube 32. The length of the tube 32 is adjusted in relation to the characteristics of the drive unit 18 and the housing 10 to provide the correct acoustic loading and to provide an acoustic filter having a resonance of 55 Hz. The effect of the resonant cavity which acts as a Helmholtz resonator is to increase the efficiency of the loudspeaker at low frequencies. Low frequency sound from the rear face of the drive unit 18 exits omni-directionally from the port tube 32 and adds to the sound coming from the front face of the drive unit 18. The position of the port tube 32 is not critical but in the present case is advantageously located between the pair of struts 18 directly opposite to the aperture 28 with respect to the centre of the plate 22.

Figure 4:
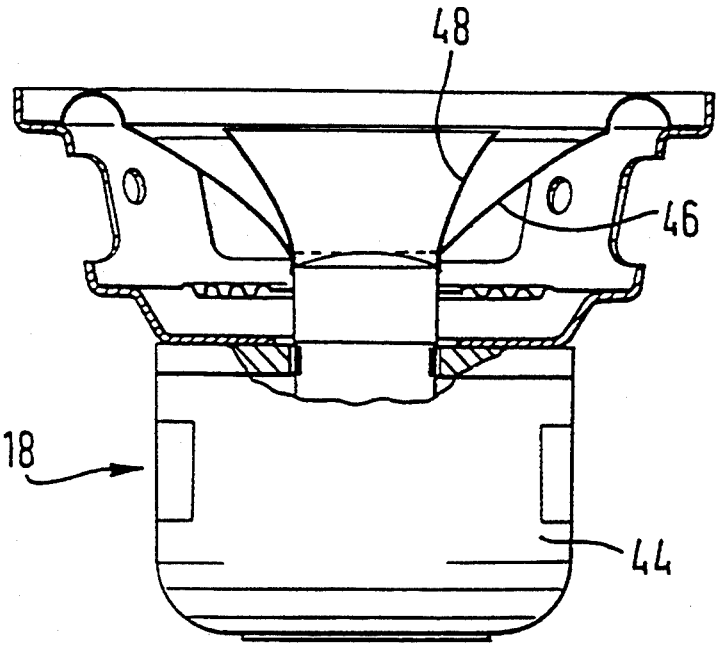
FIG. 4 is a diagrammatic partly sectioned view of the speaker or drive unit.

The drive unit 18 is shown in more detail in FIG. 4 and has a motor unit 44 and a double diaphragm arrangement in which there is a main diaphragm 46 which is effective at low and intermediate frequencies and a horn-like parasitic tweeter 48 which fits within the diaphragm 46 on which it is mounted. The main diaphragm 46 and parasitic tweeter 48 are concentric and are conventional in construction. The parasitic tweeter 48 becomes effective at about 5 KHz. The outer diameter of the main diaphragm 46 is 90 mm and the outer diameter of the parasitic tweeter 48 is 48 mm.

The sound mirror 14 provides a stand for the speaker and is of a diameter of about 250 mm and of an overall height of about 100 mm It is hollow and defines an internal space which is closed off by means of a base tray 50 which accommodates a terminal fitting 52 for receiving the signal to be reproduced and also an equaliser network 54. The apex 56 of the sound mirror 14 when viewed in plan is located approximately on the edge of the drive unit 18 as shown so that the sound is preferentially directed onto one side of the sound mirror.

The sound mirror is a solid revolution of a curvilinear profile with a straight region adjacent to the apex 56 and with a concave lower region of nominal radius of curvature 390–410 mm to diffuse the sound to provide, at least at high frequencies, a beam of sound which spreads out at an angle of +25 to −5 degrees in a direction parallel to the axis of the sound mirror 14 and in a plane normal to the axis of the sound mirror 14 has an angular distribution of approximately 110 degrees. The resulting sound intensity is sufficiently steady within the range of audible frequencies throughout this radial and axial or horizontal and vertical distribution to give satisfactory listening and a useful stereo effect. Frequencies throughout the audible range are present in the distributed sound. The above-mentioned advantageous distribution of sound arises from the combination of a single drive unit that directs sound, at least at high frequencies, in a relatively narrow beam towards the sound mirror together with the offset relationship between the drive unit and the sound mirror which enables the sound to be distributed in a preferential listening direction.

The drive unit or loudspeaker 18 directs low frequency, mid-range and high frequency sound towards the sound mirror 14. The sounds of lowest frequency, i.e., less than 200 Hz, is emitted omni-directionally, and the only effect of the sound mirror 14 is to act somewhat as a horn. At frequencies of 200 Hz to 1 KHz the mirror 14 modifies the sound, it is believed by scattering. The resulting adjustment in sound pressure level enables the sound pattern produced by the speaker unit to be adjusted to reduce colouration and to achieve a preferred polar directivity. At a transition range of frequencies of from 1 to 5 KHz which is believed to be important from the standpoint of perception of the stereo image, the direction of sound from the mirror 14 becomes increasingly directional as the frequency rises. At frequencies above 5 KHz, the sound from the drive unit 18 is reflected from the sound mirror 14 in a manner that can be generally predicted by geometrical acoustics. The curvature of the mirror 14 can be convex in both horizontal and vertical directions to achieve a desired spread of sound, or as shown and as is preferred it can be convex in a horizontal direction and concave in vertical profile. At higher frequency ranges where the parasitic tweeter 48 begins to operate, i.e., above 5 KHz, the drive unit 18 produces a relatively narrow beam of sound which is directed onto the reflective surface of the sound mirror 14, the tendency for a narrow beam to be produced becoming increasingly marked towards the upper limit of audibility. It has been found in practice that this narrow beam is very efficiently spread by the sound mirror 14, bearing in mind also the increasingly accurate direction of the beam from the drive unit 18 onto the mirror as frequency rises. The predictability of the sound distribution from the loudspeaker is increased because there is only a single effective signal source from which sound is radiated onto the mirror 14, the tweeter and the main diaphragm being concentric.

A problem arises in the support of the housing 10 in a cantilever manner above the sound mirror 14 so that its front is unobstructed because if the struts 16 supporting the dome 20 are made mechanically strong enough, they are liable to disturb the pattern of sound from the mirror 14. In order to overcome this problem, the housing 10 is supported by relatively substantial struts 16 which face towards the centre of the drive unit 18 and which as stated above subtend relatively small angles from 5 to 10 degrees, typically about 7 degrees. The angular spacing between the struts can be 40 to 60 degrees, especially 50 degrees.

Figure 5:
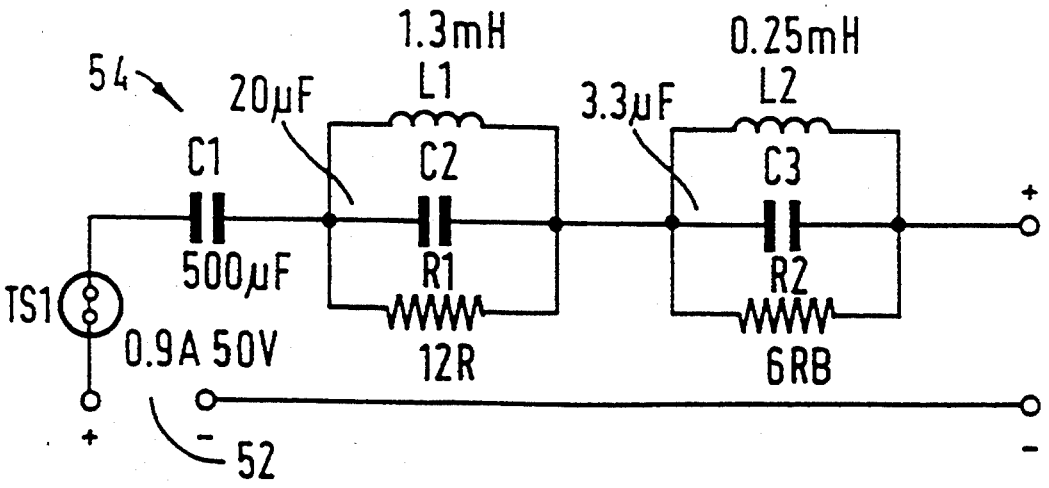
FIG. 5 is a circuit diagram of an equaliser for adjusting an incoming signal having regard to the characteristics of the speaker.

FIG. 5 shows diagrammatically an equaliser network which fits beneath the mirror 14 and modifies the incoming signal according to the characteristics of the loudspeaker. The filter selectively decreases frequencies at around 800 Hz and around 5 KHz to suit the characteristics of this particular speaker unit. The decrease at about 800 Hz is required, in this particular device, because of the spatial relationship between the sound mirror 14 and the drive unit 18, and the attenuation at 5 KHz is necessary, in this example, because of the characteristics of the particular drive unit selected.

Figure 6:
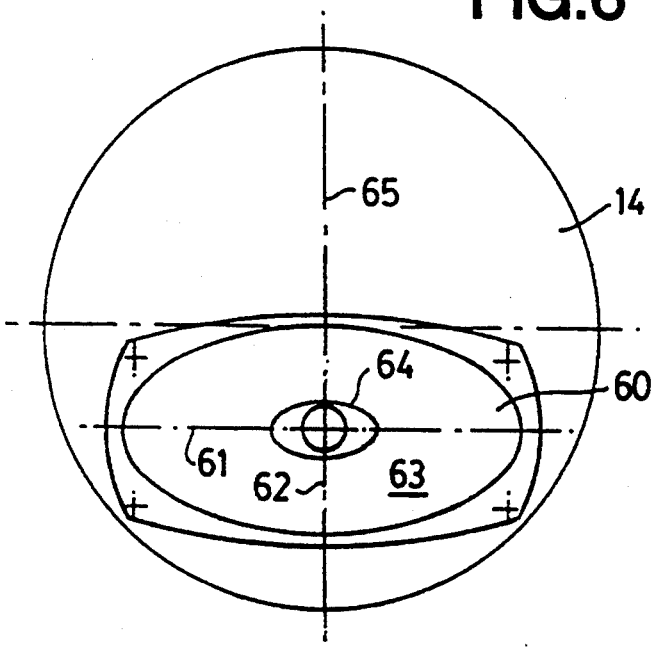
FIGS. 6 and 7 are respectively a diagrammatic elevation and plan of a second form of the speaker unit.
Figure 7:
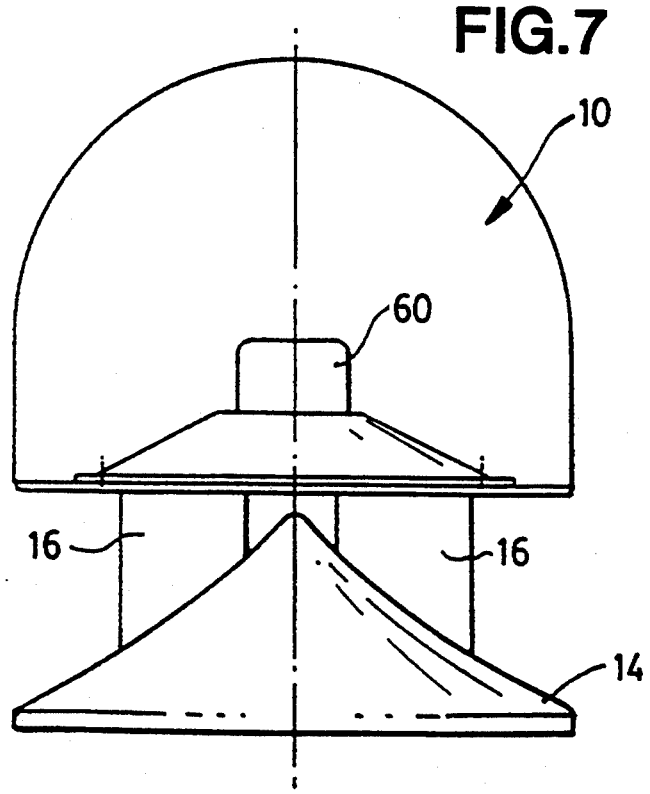

A second form of the speaker unit is shown in FIGS. 6 and 7 and incorporates a drive unit 60 in which the outer ends of both the outer diaphragm 63 and the inner horn-like parasitic tweeter 64 are elliptical in outline. In such an arrangement, for the reasons previously discussed, the major axis 61 is directed at right angles to the line 65 joining the centre of the loudspeaker 60 to the centre of the sound mirror 14, the minor axis of the speaker 60 being aligned, precisely or with some angular deviation, with the line 65.

A third form of the speaker unit is shown in FIGS. 8 and 9 and has the same arrangement of a housing 10 containing a drive unit 18 and supported in cantilever manner above a sound mirror 14 as in the previous embodiments. The drive unit 18 is, however, fed only with mid-range and upper frequencies, and the plate 22*a* does not contain a second aperture like the second aperture 30 of FIG. 1 but is instead solid except where it is apertured to receive the drive unit 18. The cavity below the top cover 20 is filled with sound-absorbent material so that the drive unit 18 is in an infinite baffle enclosure. A second drive unit 70 is provided beneath the sound reflective surface and is contained within a generally cylindrical housing 71 defined by an upper drum 73 that fits beneath the sound mirror 16 and by a lower drum 75 to which is attached lower plate 77. The drive unit 70 is carried on an internal partition 79 of the housing 71 and they together divide the internal space of the housing into an upper chamber 81 which is filled with sound-damping material and a lower chamber 83 which is empty and is provided with an upstanding pipe 85 which communicates the interior of the chamber 83 with the outside air and serves to define a downwardly directed Helmholtz resonator having a resonant frequency in the bass range. The drive units 18,70 are fed with sound through a cross-over network 90 (FIG. 9) having a cross-over frequency 160 to 170 Hz.

The housing 71 is supported above the ground on a support ring 91 which may optionally be provided with spike feet 92 or with rubber pads 93 depending upon the acceptable load which can be exerted by the speaker on the floor or platform on which it is to stand. The sound mirror 14 and the partition 79 are rigidly connected to the support ring 91 by means of threaded rods 95 which extend from the support plate 91 through the partition 79 to the sound mirror 14. The rods or tie bars 95 are advantageously of steel or other metal and are of a half-inch diameter and they rigidly connect the sound mirror 14 to the support ring 91 and thence to the ground. The drive unit 18 is in turn rigidly connected through the base plate 22*a* and struts 16 to the sound mirror 14, and all the important load transmitting components are of metal so that they are substantially not moved when the drive unit 18 and/or 70 is working and the drive units are effectively coupled to the ground or rigid platform on which the speaker stands. The drums 71, 75 are not in the load path between the drive units and the ground and can be made of lighter material. With this arrangement degradation of sound quality resulting from movement of the cabinets in which the drive units are housed is reduced.

The tube 85 opens into a cavity defined between the support ring 91 and the lower plate 77, and a second pipe 97 depends from that cavity towards the ground. With this arrangement sound from the drive unit 70 is reflected at the floor and bass frequencies are boosted by the so-called first boundary assistance phenomenon which add in this case about 3 db of intensity to the bass sound radiated from the speaker.

Figure 10:
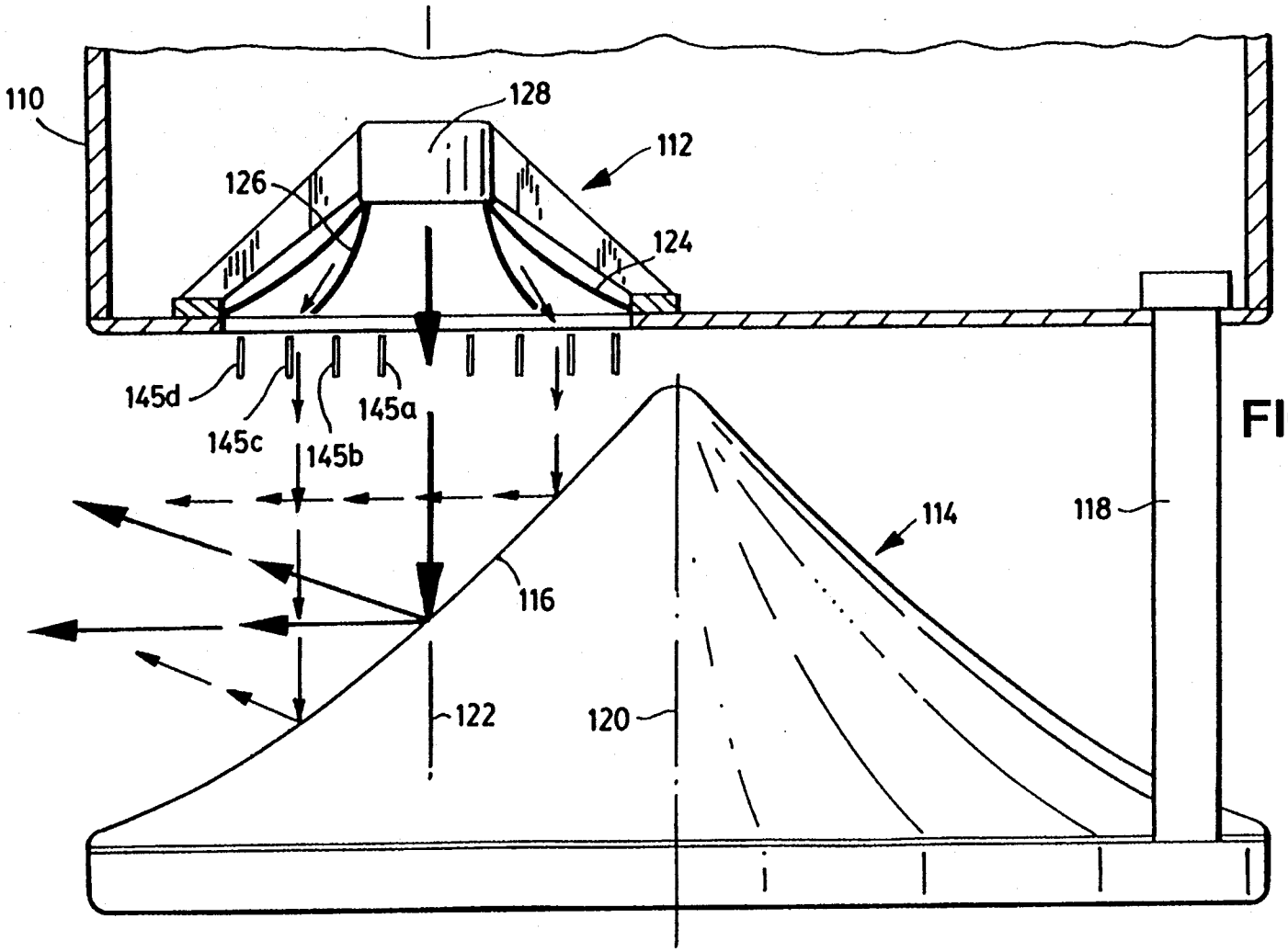
FIG. 10 is a diagrammatic partly sectional side view of a fourth form of a speaker assembly according to the invention.

In FIG. 10 there is shown a speaker unit comprising a cabinet 110 housing a mid and high frequency loud speaker 112 arranged with its axis or sound emitting direction vertically downwards as shown. A sound mirror 14 which is symmetrical about its axis and has a reflecting wall 16 of smoothly curving upwardly concave profile is supported from the cabinet 10 by a depending post 18. The axis 120 of the sound mirror 14 is offset from the axis or centre line 122 of the loudspeaker 12, the intended listening direction being a horizontal direction generally level with the sound mirror 114 and in or adjacent the plane passing through the axes 120, 122. The curvature in an upward direction of the reflective wall 116 of the sound mirror serves to cause divergence of the reflected sound in a vertical direction.

The speaker unit has a diaphragm 124 whose overall depth is 24 mm and which has a central or dome area of diameter approximately 26 mm, and the diaphragm 124 curves smoothly outwards towards its mouth which is of a diameter of approximately 90 mm. Located centrally within the diaphragm 24 and arising from the same line as the back end of the diaphragm is a second horn-like diaphragm 126 which is flared forwardly and outwardly as shown to reach a maximum diameter of about 55 mm at its mouth end. The diaphragm 124 and horn 126 are moved together by a common driver unit diagrammatically illustrated by the reference numeral 128.

Figure 11A:
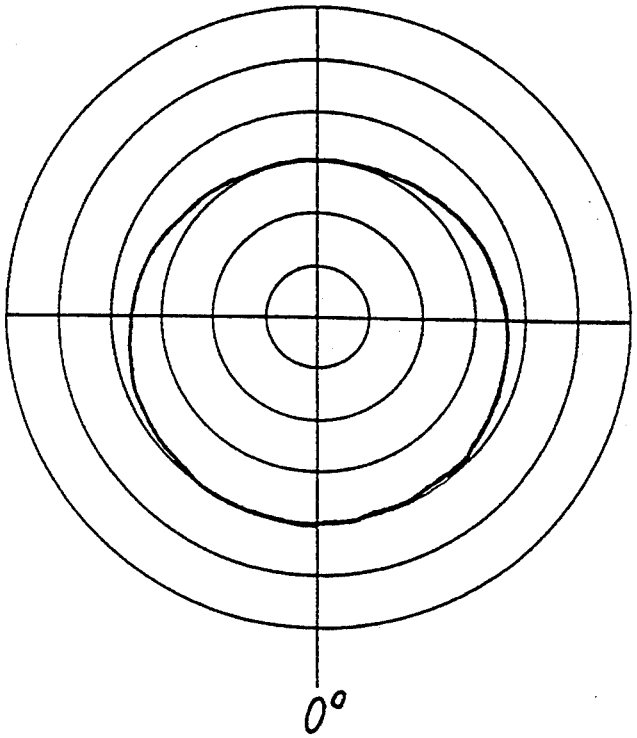
FIG. 11*a* to 11*f* are plots showing the polar distribution of radiated sound intensity measured in a generally horizontal plane level with the sound mirror at the various frequencies and with no means provided between the tweeter and the sound mirror for directing high frequency sound onto the mirror.
Figure 11B:
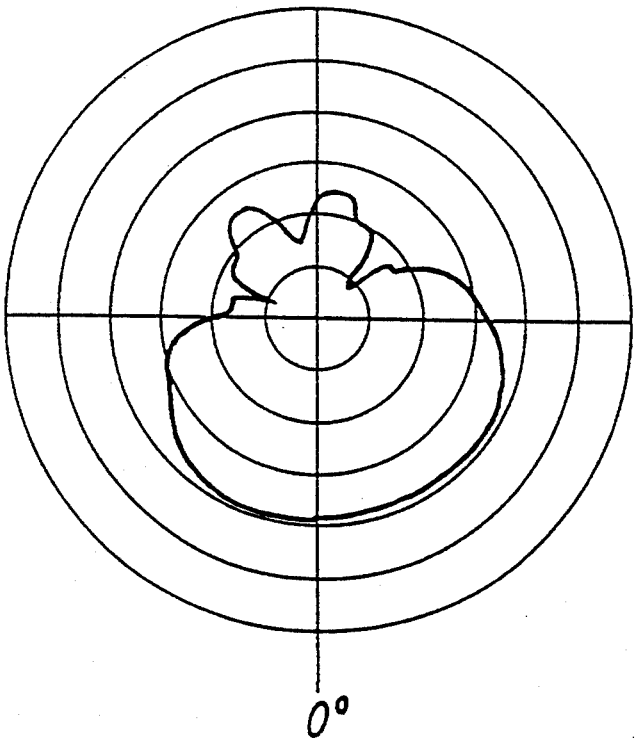
Figure 11C:
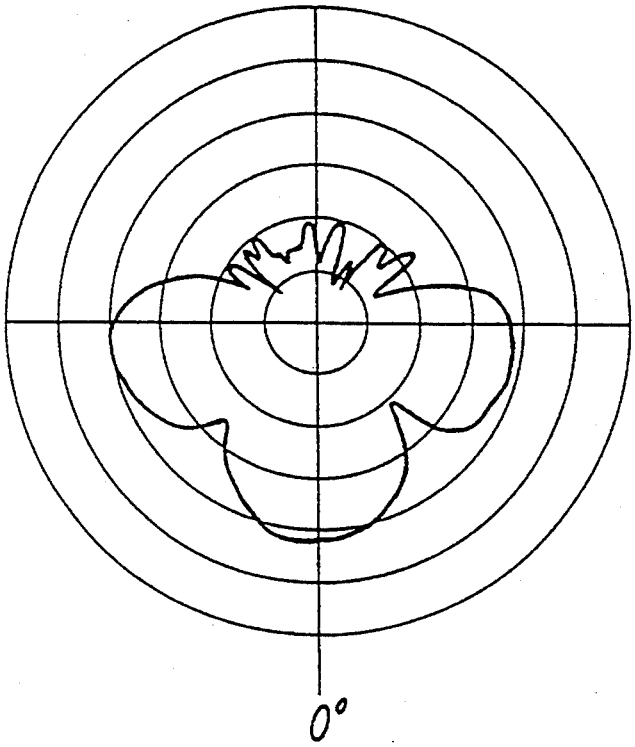
Figure 11D:
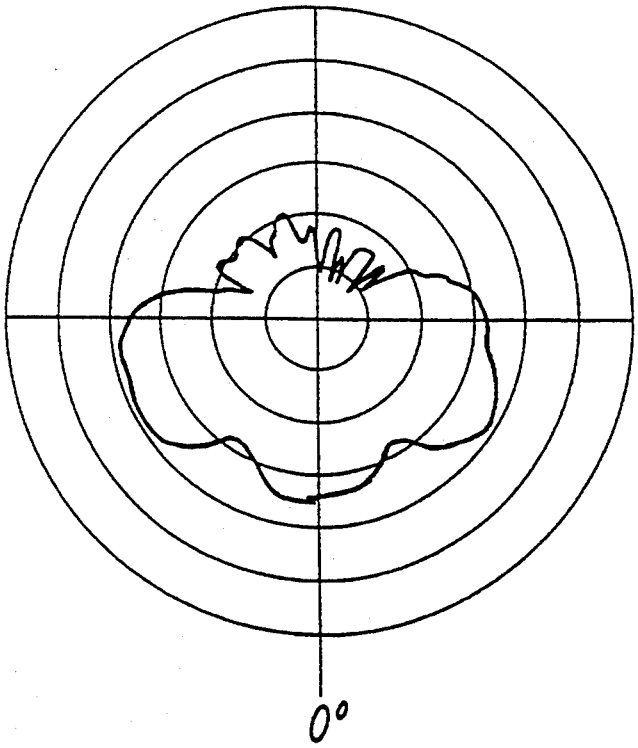
Figure 11E:
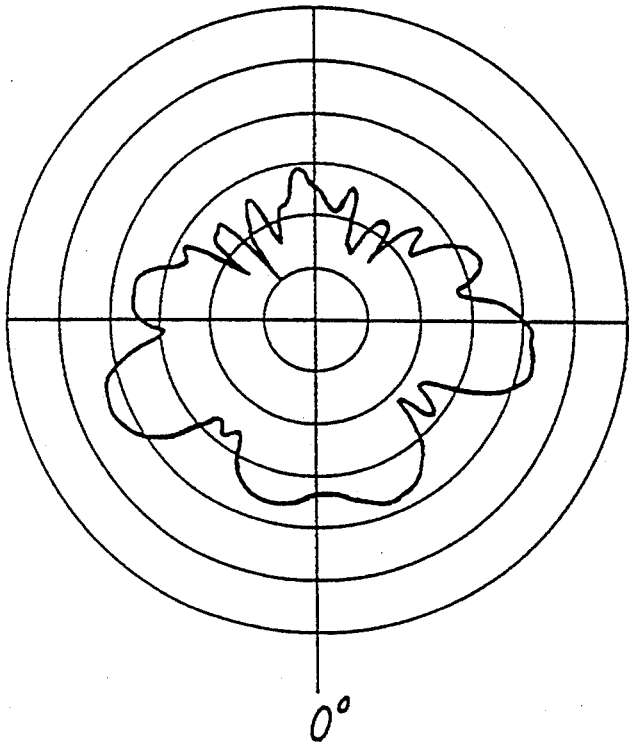
Figure 11F:
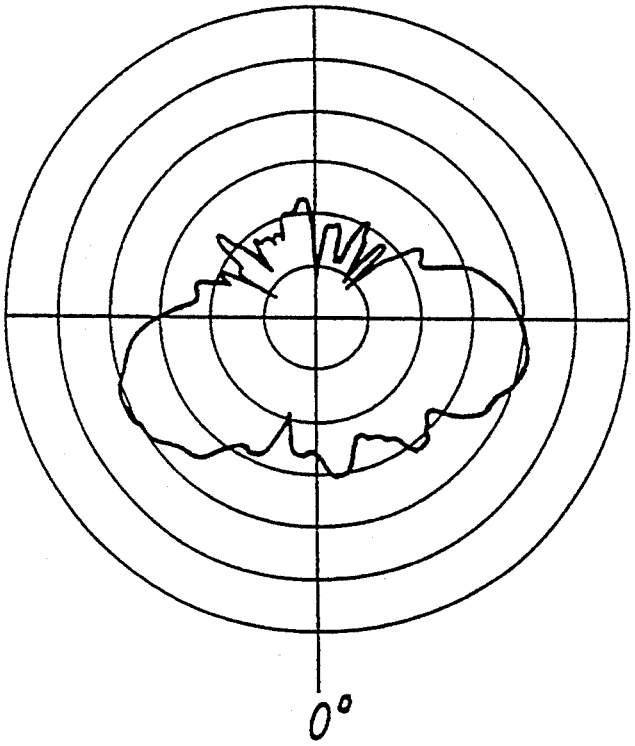

The distribution of sound produced by a speaker generally as shown in FIG. 10 was measured in the plane of the sound mirror 114 for a range of frequencies, and the results are shown in FIGS. 11*a* to 11*f*. In FIG. 11*a* where the sound being detected was at 460 Hz a smoothly varying distribution of sound was produced all around the speaker assembly, with the intensity of sound predominating in the listening direction. FIG. 11*b* shows a measurement at 5 KHz and shows a high intensity in the listening direction with relatively little fall off up to angles of 30 degrees to either side of the listening direction but relatively little rearwardly reflected sound. FIG. 11*c* shows a measurement taken at 12.5 kHz and again shows the greatest intensity of sound in the listening direction, but the sound falls off away from the listening direction to a minimum and a substantial intensity appears at right angles to the listening direction. In FIG. 11*d* which shows a measurement at 15 kHz the pattern is similar but with the sound in the listening direction being of similar intensity to the sideways sound. At 17.5 kHz (FIG. 11*e*) the greatest intensity is in lobes that appear generally to the sides of the listening direction and the same pattern of sound distribution appears in an even more pronounced manner in FIG. 11*f* which shows the distribution at 20 kHz.

It is apparent from FIGS. 11*a* to 11*f* therefore, that although the speaker shown in FIG. 1 gives a satisfactory intensity of sound in the listening direction in the mid frequency range, at frequencies above 15 kHz there is a falling off of intensity in the listening direction and unwanted intensity at right angles to the listening direction.

Figure 12:
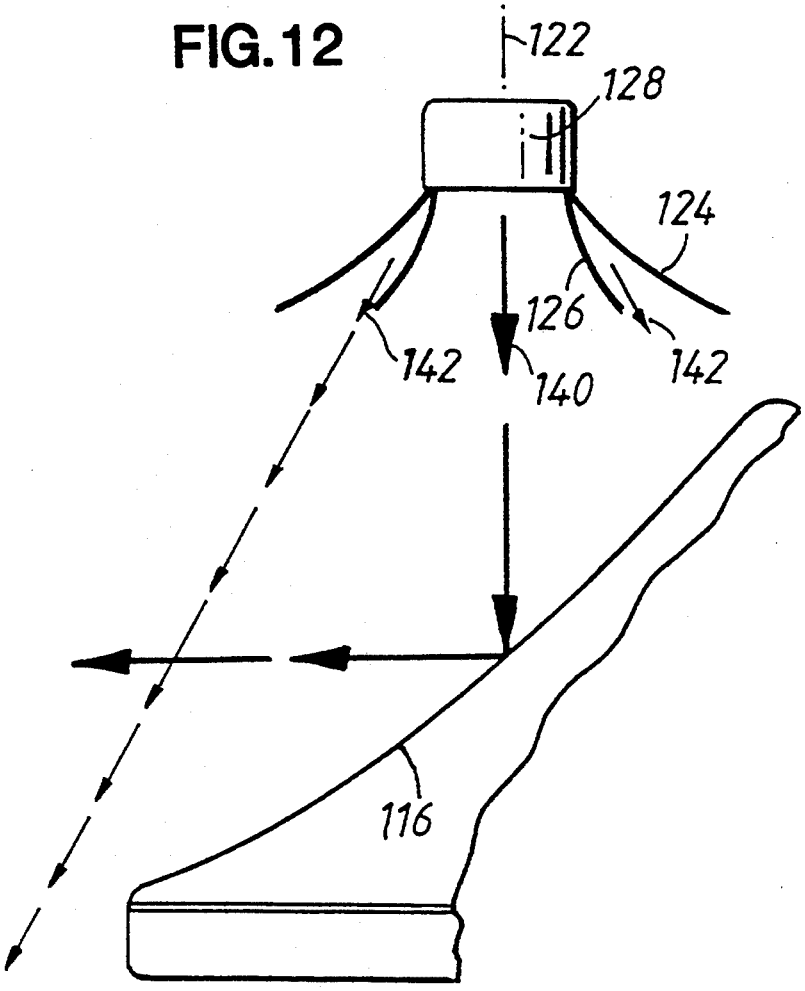
FIG. 12 is a diagram of a speaker and part of the sound mirror showing a mechanism by which high frequency sound may fail to reach the sound mirror.
Figure 13:
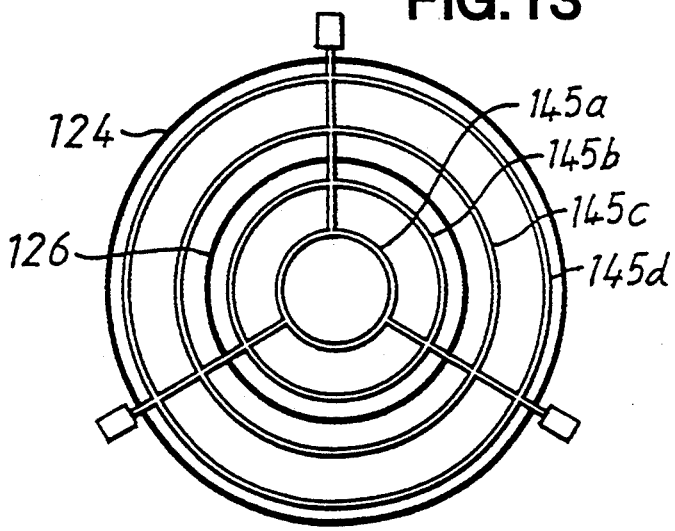
FIG. 13 is a diagramatic underneath view of the tweeter and a sound re-directing member supported beneath it.

Although the invention does not depend for its operation on the correctness or otherwise of this theory, it is believed that at frequencies above 15 kHz the parasitic tweeter 126 can act as a wave guide with the result that the sound follows the surface of the parasitic tweeter and does not follow the expected direction of propagation. For example, sound of frequency 17.5 kHz has a wavelength of just under 20 mm which matches the height of the parasitic tweeter which then acts as a regulator or wave guide. At frequencies below 15 kHz the main sound intensity is in an axial direction as indicated by the arrow 140 in FIG. 12, but at intensities of e.g. of about 17.5 kHz or above, the main sound intensity is tangential to the rim of the horn 126 and is directed at an angle to the axis 122 as indicated by the arrows 142. Sound at high frequencies may therefore fail to reach the reflective surface 116 of the sound mirror, and it is believed that this phenomenon is at least partly responsible for the falling off in intensity of high frequency reflected sound in the listening direction and/or the unwanted intensities in other directions. Because the axis 122 of the speaker 112 is offset from the axis 120 of the sound reflector 114, a sideways going sound is more likely to hit the audio mirror which is believed to be the reason of why the side lobes of FIGS. 11*e* and 11*f* appear.

Where this phenomenon occurs, it may be remedied, according to an aspect of the invention by attaching a regulator in front of the loud speaker 12 to redirect sound of high frequency so that its main intensity continues to hit the audio mirror 116. For this purpose of a series of concentric vanes 145*a* to 145*d* of circular or other convenient shape when viewed in plan is attached to the housing 110 beneath the loud speaker 112. The vanes may conveniently be rectangular when viewed in section with their long side wall directed parallel to the axial direction and they may be of depth about 10 mm. They may be made of any convenient material, for example metal, so called "dumped metal" which is a sandwich of metal with an elastomeric material, or they may be made of a rigid plastics material. As best seen in FIG. 13 the diameter of the vane 145C is slightly larger than the mouth diameter of the horn 126, with a spacing when viewed in underneath plan as in FIG. 4 of about 6 mm therebetween. The spacing between the rim of the horn 126 and the plane containing the inner ends of the vanes 26 is 10 mm.

Figure 14:
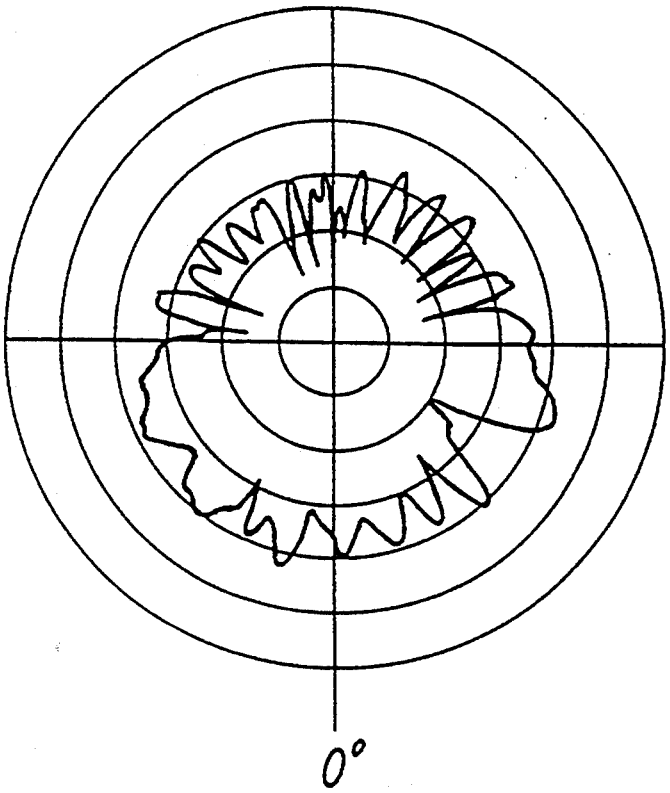
FIG. 14 is a plot showing the intensity distribution with angle of high frequency sound radiated from the audio mirror of the speaker assembly according to the invention.

In FIG. 14 there is shown a measured polar distribution of sound intensity with the sound re-directing member containing vanes 145A to 145D in place, and it is apparent that the distribution of the reflected sound is generally more uniform. The intensity of reflected sound is increased both in the intended listening direction itself and at angles close to the intended listening direction.

Modifications may be made to the form of the invention described above without departing from the invention, the scope of which is defined in the appended claims. The drive unit may face upwardly rather than downwardly, the sound mirror 114 then being inverted. The sound re-directing member may not include vanes that are circular in plan and, for example, it may comprise intersecting vanes that form a grid. The sound reflector could be of other shapes e.g., a simple cone rather than a concave shape. The cone 124 is preferably conical but other outlines, e.g., an elliptical outline are not excluded.

We claim:

1. A speaker unit comprising:

a speaker housing having a lower portion and an upper portion;

a drive unit housed in said upper portion for producing and outputting sound, with said drive unit having a central axis;

a sound mirror housed in said lower portion for reflecting the sound output by said drive unit, said mirror having a generally conical surface facing said drive unit for redirecting sound therefrom into a generally horizontal direction and a cone shape, with an apex of said cone being closest to said drive unit; and means for supporting said drive unit in a cantilever-type manner above said sound mirror, wherein the center axis of said drive unit is offset from said apex of said sound mirror, and said supporting means is positioned at substantially the opposite side of said apex than the center axis of said drive unit.

2. A unit according to claim 1, wherein said speaker housing is closed except for an aperture, and said upper portion includes a space in communication with the aperture, the space defining a Helmholtz resonator operating at bass frequencies, the aperture being located opposite from said drive unit with respect to said apex.

3. A unit according to claim 1 or 2, wherein said speaker housing has the form of a dome closed at its lower end by a plate which provides a mounting for said drive unit.

4. A unit according to claim 1, wherein the drive unit has concentric first and second diaphragms for lower and higher frequencies.

5. A unit according to claim 4, wherein said second diaphragm fits within but is unattached to said first diaphragm, said first and second diaphragms being independently driven.

6. A unit according to claim 4, wherein said second diaphragm fits within and is attached to said first diaphragm and a single drive vibrates both diaphragms.

7. A unit according to claim 6, wherein said second diaphragm is horn-like and is arranged at high frequencies to direct sound in a relatively concentrated beam onto the audio mirror.

8. A unit according to of claim 4, wherein said second diaphragm is arranged to come into operation at frequencies above 5 kHz.

9. A unit according to of claim 4, wherein said second diaphragm is circular in outline at its inner and outer ends.

10. A unit according to claim 4, wherein said first diaphragm is circular in outline at its inner and outer ends.

11. A unit according to claim 4, wherein the second diaphragm is elliptical in outline at its outer end.

12. A unit according to claim 4, wherein the first diaphragm is elliptical in outline at its outer end.

13. A unit according to claim 4, wherein means is disposed between the drive unit and the audio mirror for directing high frequency sound from the second diaphragm onto the audio mirror.

14. A unit according to claim 13, wherein the sound directing means comprise one or more surfaces inserted between the rim of the second diaphragm and the mirror.

15. A unit according to claim 14, wherein the sound directing means includes a surface Which conforms to and is slightly larger than the rim of the second diaphragm and is positioned adjacent to the rim of the second diaphragm.

16. A unit according to claim 15, wherein the spacing in front view between the rim of the second diaphragm and the surface of the sound directing means is 5 to 15 mm and the sound directing means is 7 to 15 mm in front of the surface of the second diaphragm.

17. A unit according to claim 2, wherein the frequency of the Helmholtz resonator is about 50 Hz.

18. A unit according to any of claim 1, wherein the drive unit fits into a closed housing.

19. A speaker unit as claimed in claim 18, wherein a single drive unit is arranged to reproduce mid-range and high frequency sound and a drive unit for bass frequencies is provided in a housing to an opposide side of the sound mirror from the said single drive unit.

20. A speaker unit as claimed in claim 19, wherein the single drive unit and bass drive unit are connected to a sound source by a network having a cross-over frequency of about 160–170 Hz.

21. A speaker unit according to claim 20, wherein the bass speaker is mounted in a housing which is closed except for an aperture or apertures defining a Helmholz resonator.

22. A speaker unit according to claim 18, wherein the aperture or apertures defining the Helmholz resonator are downwardly directed with reference to the normal attitude of the speaker when in use.

23. A speaker unit according to claim 19, wherein the bass speaker is in a housing which has a smoothly curved side wall.

24. A loudspeaker unit according to claim 1, further comprising at least one strut for supporting said speaker housing above said drive unit, wherein each said strut has a length greater than its width and the length is directed towards the center of said drive unit.

25. A speaker unit according to claim 24, wherein each said strut subtends an angle of 5 to 10 degrees with respect to the center axis of said drive unit.

26. A speaker unit according to claim 24 or 25, wherein there are two struts.

27. A speaker unit according to claim 26, wherein an angular spacing between said two struts when viewed from said apex is 40 to 60 degrees.

28. A speaker unit according to claim 26, wherein the aperture or apertures defining the Helmholtz resonator exit between the struts.

* * * * *

UNITED STATES PATENT AND TRADEMARK OFFICE

CERTIFICATE OF CORRECTION

PATENT NO. : 5,418,336

DATED : May 23, 1995

INVENTOR(S) : Negishi et al.

It is certified that error appears in the above-indentified patent and that said Letters Patent is hereby corrected as shown below:

COLUMN 8:

Line 9, "mirror 14" should read --mirror 114--.
Line 10, "wall 16" should read --wall 116--.
Line 11, "cabinet 10" should read --cabinet 110--.
Line 12, "post 18." should read --post 118.-- and "mirror 14" should read --mirror 114--.
Line 14, "12," should read --112,--.
Line 25, "diaphragm 24" should read --diaphragm 124--.

COLUMN 9:

Line 25, "loud speaker 12" should read --loudspeaker 112--.
Line 43, "vanes 26" should read --vanes--.
Line 62, "cone 124" should read --diaphragm 124--.

COLUMN 10:

Line 65, "Which" should read --which--.

COLUMN 11:

Line 8, "any of" should be deleted.
Line 14, "opposide" should read --opposite--.
Line 23, "Helmholz" should read --Helmholtz--.

UNITED STATES PATENT AND TRADEMARK OFFICE

CERTIFICATE OF CORRECTION

PATENT NO. : 5,418,336 Page 2 of 2

DATED : May 23, 1995

INVENTOR(S) : Negishi et al.

It is certified that error appears in the above-indentified patent and that said Letters Patent is hereby corrected as shown below:

COLUMN 12:

Line 2, "Helmholz" should read --Helmholtz--.
Line 8, "loudspeaker" should read --speaker--.

Signed and Sealed this

Twenty-seventh Day of February, 1996

*Attest:*

Bruce Lehman

BRUCE LEHMAN

*Attesting Officer*

*Commissioner of Patents and Trademarks*